United States Patent [19]

Garg et al.

[11] Patent Number: 4,472,263

[45] Date of Patent: Sep. 18, 1984

[54] PROCESS FOR SOLVENT REFINING OF COAL USING A DENITROGENATED AND DEPHENOLATED SOLVENT

[75] Inventors: Diwakar Garg, Macungie; Edwin N. Givens, Bethlehem; Frank K. Schweighardt, Allentown, all of Pa.

[73] Assignee: Air Products and Chemicals, Inc., Allentown, Pa.

[21] Appl. No.: 399,671

[22] Filed: Jul. 19, 1982

[51] Int. Cl.[3] ..... C10G 1/00

[52] U.S. Cl. ..... 208/8 LE; 205/10

[58] Field of Search ..... 208/8 LE, 8 R, 10

[56] References Cited

U.S. PATENT DOCUMENTS

| | | | |
|---|---|---|---|
| 4,056,460 | 11/1977 | Malek | 208/8 |
| 4,057,484 | 11/1977 | Malek | 208/8 |
| 4,081,351 | 3/1978 | Heinemann | 208/8 |
| 4,125,452 | 11/1978 | Effron | 208/8 |
| 4,133,646 | 1/1979 | Farcasiu et al. | 208/8 LE |
| 4,269,692 | 5/1981 | Babu et al. | 208/10 |
| 4,347,116 | 8/1982 | Whitehurst et al. | 208/8 LE |
| 4,350,582 | 9/1982 | Rosenthal et al. | 208/8 LE |
| 4,374,015 | 2/1983 | Brulé | 208/8 LE |
| 4,374,725 | 2/1983 | Whitehurst et al. | 208/8 LE |
| 4,405,437 | 9/1983 | Kulik et al. | 208/10 |

*Primary Examiner*—Delbert E. Gantz
*Assistant Examiner*—Lance Johnson
*Attorney, Agent, or Firm*—Geoffrey L. Chase; E. Eugene Innis; James C. Simmons

[57] ABSTRACT

A process is disclosed for the solvent refining of non-anthracitic coal at elevated temperatures and pressure in a hydrogen atmosphere using a hydrocarbon solvent which before being recycled in the solvent refining process is subjected to chemical treatment to extract substantially all nitrogenous and phenolic constituents from the solvent so as to improve the conversion of coal and the production of oil in the solvent refining process. The solvent refining process can be either thermal or catalytic. The extraction of nitrogenous compounds can be performed by acid contact such as hydrogen chloride or fluoride treatment, while phenolic extraction can be performed by caustic contact or contact with a mixture of silica and alumina.

11 Claims, 1 Drawing Figure

PROCESS FOR SOLVENT REFINING OF COAL USING A DENITROGENATED AND DEPHENOLATED SOLVENT

TECHNICAL FIELD

The Government of the United States of America has rights in this invention pursuant to Contract No. DE-AC22-ET14806 awarded by the U.S. Department of Energy.

The present invention is directed to the production of synthetic fuels from non-anthracitic coals. The process concerns the production of liquid hydrocarbons and normally solid solvent refined coal from raw, mined coal or potentially insubstantially pretreated coal. Specifically, the present invention is directed to an improved solvent refining process for coal in which the process solvent is subjected to treatment for the extraction of nitrogenous and phenolic compounds before use or recycle in the process system.

BACKGROUND OF THE PRIOR ART

The field of coal treatment and upgrading to provide various fuels and particularly liquid fuels which would replace petroleum derived liquid fuels has been the subject of intense research from the 1920's in Germany through the present worldwide energy dilemma. The techniques used to recover more easily utilized fuels from raw coal are generally termed coal liquefaction. Coal liquefaction can be performed in a wide variety of processes which are performed on non-anthracitic coals, such as bituminous, sub-bituminous and lignitic coals, as well as other organic materials such as peat.

Coal liquefaction may be performed in a thermal or catalytic process. In a thermal process, heat is utilized to perform the liquefying function of the process along with any catalysis which may occur due to indigenous minerals found in the coal naturally. In a catalytic process, an added catalyst in conjunction with heat is utilized to perform the liquefying function of the process. In addition, the catalytic reaction can be performed in any number of reactors, such as a slurry phase reactor and an ebullated bed reactor.

Generally, coal liquefaction processes attempt to break weak heteroatom and carbon to carbon linking bridges in the coal molecular structure and then hydrogenate the resulting radicals to inhibit polymerization to high molecular weight structures. Hydrogen is necessary to perform this function in coal liquefaction operations which operate as a hydrogenation reaction. Hydrogen can be added to a coal liquefaction reaction in the gas phase, but those skilled in the art have found that hydrogen is best introduced into the liquefaction reaction by a hydrogen donor solvent. Such solvents must be miscible with the coal reaction products and must also reversibly hydrogenate and dehydrogenate in order that hydrogen can be loaded on the solvent, introduced into the reaction medium and donate the hydrogen to the feed coal that is liquefying. The hydrogen depleted solvent is then separated from the liquid coal product and is rehydrogenated and returned or recycled for further duty in the coal liquefaction reaction.

In recycling hydrogen donor solvent, the prior art has performed various separations and purifications of the recycle solvent in order to benefit the reaction to which the solvent is introduced. For example, U.S. Pat. No. 4,056,460 teaches the beneficial effect of recycling or adding amines and phenols as coal solvent constituents. A process is described in which phenols and amines are extracted from coal liquids and are recycled to the liquefaction zone. The patent identifies the phenolic functionalities in asphaltenes and states that although asphaltenes should not be recycled to the liquefaction reaction, after a reduction in molecular weight, the corresponding phenols are beneficial recycle solvents.

U.S. Pat. No. 4,057,484 discloses that acid-base structures in asphaltenes must be decomposed with either acid alone or caustic alone before a portion of the asphaltenes are recycled as pasting solvent for coal liquefaction.

In U.S. Pat. No. 4,081,351, a coal extract is denitrogenated before going to a catalytic cracker reaction vessel in order to protect the catalyst in the hydrocracker from nitrogenous components in the coal extract. A portion of the fractionated effluent from the catalytic cracker vessel is recycled and incorporated with petroleum solvent for utilization in a coal liquefier.

U.S. Pat. No. 4,125,452 discloses a coal liquefaction process in which a recycle solvent is separated from phenol-containing material and the phenol-free solvent is rehydrogenated before recycle to a coal liquefier.

In U.S. Pat. No. 4,133,646 it is stated that a coal liquefaction process wherein 3 to 50% of phenols are recycled as solvent is a desired goal of the patented process.

The prior art, as evidenced above, has treated the effluent and the recycled solvent of coal liquefaction processes in various ways in order to benefit the products from coal liquefaction or the liquefaction reaction itself. However, the prior art has not recognized the advantage set forth below in the present invention wherein nitrogenous and phenolic constituents of a solvent are removed prior to the solvent being introduced into a coal liquefaction reaction. In addition, it is an advantage of the present invention to not rehydrogenate the recycle solvent before introduction into the coal liquefaction reaction in order to avoid the production of phenolic components by the interaction of residual ethers in the solvent and hydrogen which would be administered in a rehydrogenation step. However, rehydrogenation followed by phenol extraction could be performed. An improved liquefaction reaction with increased oil production is experienced when the denitrogenation and the dephenolation of the present invention is performed on a coal solvent, particularly in the absence of a separate rehydrogenation step where phenols could be reformed.

BRIEF SUMMARY OF THE INVENTION

The present invention is directed to a coal liquefaction or solvent refining process for coal which is performed at elevated temperature and pressure in a hydrogen atmosphere using a hydrogen donor solvent which is recycled to the liquefaction or refining process wherein said process produces liquid hydrocarbons and normally solid, solvent-refined coal. The process includes the treatment of the solvent to extract a significant amount or substantially all nitrogenous and phenolic constituents therefrom prior to introduction of the treated solvent into the liquefaction or refining process reactor. The process of the present invention excludes the separate rehydrogenation of the solvent in order to avoid the formation of phenolic components from ethers in the solvent and relies on in-situ rehydrogenation of the solvent in the liquefaction or refining reactor.

The process can be performed in a thermal or catalytic manner. The catalytic reaction can be performed in a slurry phase reactor or an ebullated bed reactor.

Advantageously, the nitrogenous materials are removed from the solvent by contact of the solvent with hydrogen chloride, while the phenolic compounds are removed from the solvent by contact of the solvent with sodium hydroxide.

Alternately, only one constituent, either nitrogenous or phenolic, can be removed from the recycle solvent in the catalytic process. One manner of achieving this is to distill the solvent from the coal liquefaction zone into a 650° F. and less fraction which is inherently phenol-rich, and a 650° F. and above fraction which is inherently nitrogen rich. Then three modes of treatment are possible. Either the lower or upper distillation cut can be treated to remove its respective rich-constituent and then the cuts are recombined for recycle, or both cuts can be treated and recombined for recycle. In this manner treatment is favorably performed on only a portion of the entire solvent stream for each component extraction.

Optionally, a portion of the solvent can be bypassed from solvent treatment if it is already low in concentration of the nitrogenous or phenolic constituents.

It is also an advantage of the present invention to utilize a combination of silica and alumina to remove the phenolic compounds from the solvent.

Other acidic, surface active agents can be utilized to extract phenolic constituents optionally, such as clays, charcoals, aluminas and silica-alumina.

DETAILED DESCRIPTION OF THE INVENTION

Figure 1:
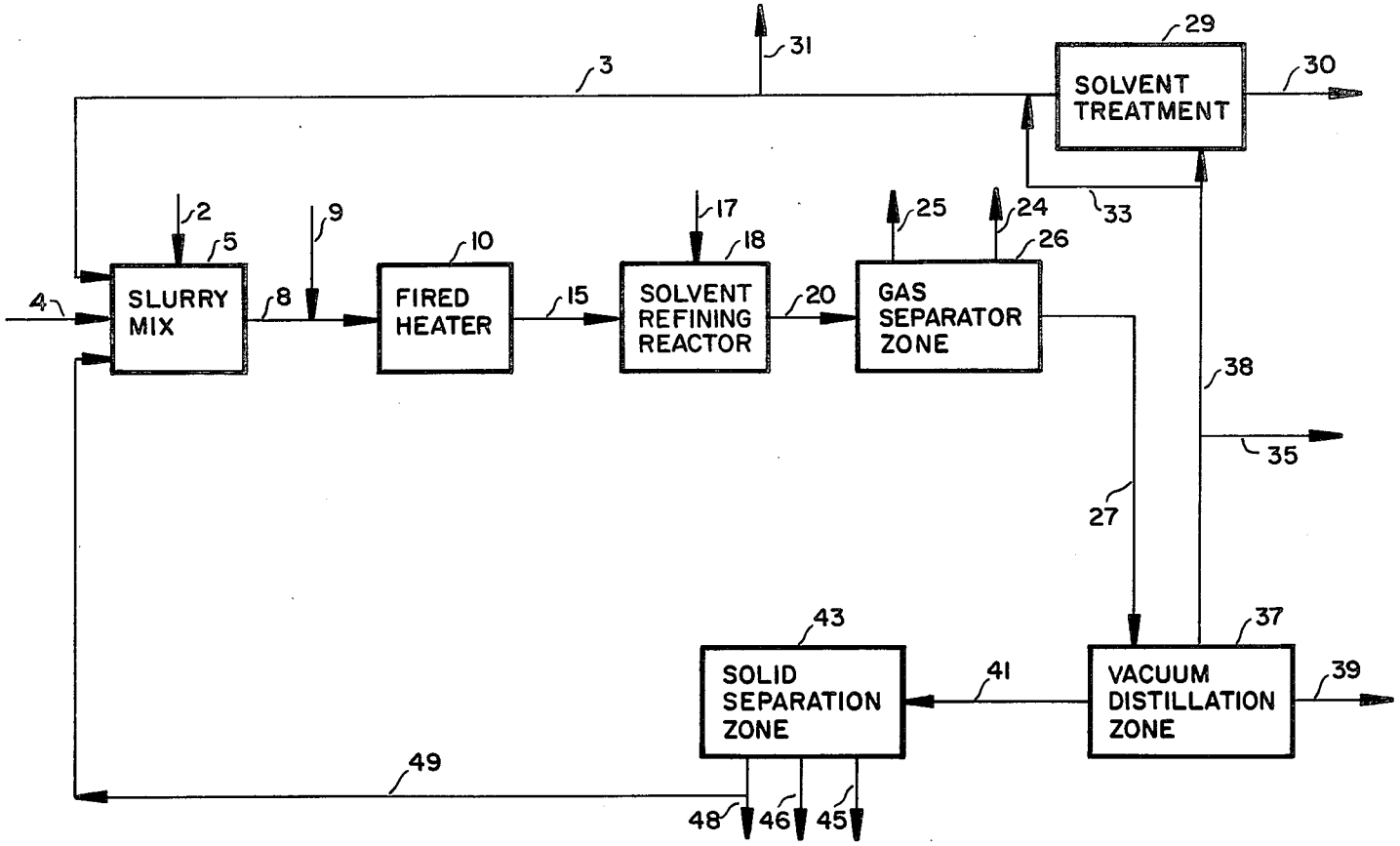
FIG. 1 represents an outline flow scheme of one embodiment of the present invention demonstrating a slurry catalyzed solvent refining process for coal.

The liquefaction or solvent refining of coal using the improvement of the present invention can be practiced in a plurality of known processes such as a thermal, non-catalyzed process, a catalyzed process using an ebullated bed reactor, or a slurry phase reactor. Other processes for the production of liquid hydrocarbon fuels from coal could also benefit from the improvement of the present invention. Such processes include the thermal processes such as Exxon donor solvent as set forth in U.S. Pat. Nos. 3,726,784, 4,085,031, 4,085,032, 4,085,033, and 4,283,267; SRC-I as set forth in U.S. Pat. Nos. 3,884,796, 4,111,663, 4,190,518 and 4,312,763; and SRC-II as set forth in U.S. Pat. Nos. 3,884,794, 3,884,795, 3,884,796 and 3,892,654. Appropriate catalytic processes include the H-coal as set forth in U.S. Pat. Nos. 3,519,555, 3,540,995, 3,700,584, 3,755,137, 3,856,658, 3,962,070, 4,045,329 and 4,054,504; Synthoil as set forth in German Pat. No. 2,700,309 and The Dow coal liquefaction process as set forth in U.S. Pat. Nos. 4,102,775 and 4,136,013 and British Pat. No. 1,596,556. All of the above-identified references are hereby incorporated herein by reference.

In a thermal process, the particulate coal is slurried with solvent and raised to an elevated temperature to refine the coal to lower molecular weight products. Catalyst is not added, but some indigenous minerals in the coal may catalyze the process to some extent.

In a catalytic process, the solvent and particulate coal are contacted with an added catalyst in the reactor. In a catalytic slurry phase reactor, the catalyst is added to the coal and solvent prior to introduction into the reactor. The catalyst is a fine powder, generally −200 mesh or less. Water or organic solvent soluble catalyst can be impregnated directly on the coal or an oil soluble catalyst can be dissolved directly in the solvent. Water soluble catalysts can be used in which the aqueous catalyst solution is emulsified in the coal solvent. A catalytic ebullated bed requires a larger particulate catalyst than the slurry phase process, wherein the catalyst is retained in the ebullated bed while solvent and particulate coal are fed in an upflow manner through the bed. Supported catalyst can also be used. A catalytic fluidized bed can also be used under similar process conditions to the ebullated bed, but the fluidized catalyst bed is more uniformly expanded. Finally, the catalytic process can be performed in a fixed bed, wherein the solvent and particulate coal dispersion are passed through a close-packed, unexpanded bed of catalyst.

The feed coal which may be processed in the present invention for liquefaction or solvent refining includes non-anthracitic coals such as those coals having a lower rank than anthracite and including bituminous, sub-bituminous or lignite coals. Additionally, other organic feedstocks such as peat are within the contemplation of the present invention.

The solvent is generally a coal derived liquid boiling at 425° F.+. However, the solvent can also be derived from petroleum, shale or tar sands, although during processing it will slowly be replaced with coal derived liquids.

Suitable catalysts include any of the known hydrogenation catalysts such as the oxides and sulfides of transition metals particularly Group VIII and Group VIB. The catalysts can be used individually or in combination and in a supported or unsupported form. Typical catalysts include metals from Groups IVB, VB, VIB, VIIB and VIII. The metals can be used individually or in various combinations as taught in U.S. Pat. No. 2,227,672 incorporated by reference. Preferably, metals as their oxide or sulfides are utilized. The catalyst can be in the form of water soluble or organic compound soluble salts which are impregnated on the feed coal or emulsified in the solvent. Suitable supported catalysts include cobalt-molybdenum-aluminum, nickel-molybdenum-aluminum, nickel-tungsten, and cobalt-tungsten. Suitable supports are alumina, silica, zirconia or titania. Activated clays can also be used as catalyst supports. Oil soluble metal compound catalysts can also be used. Suitable oil soluble catalysts include: (1) inorganic metal halides, oxyhalides and heteropoly acids, (2) metal salts of organic acids, such as acyclic, alicyclicaliphatic organic acids, (3) organometallic compounds and (4) metal salts of organic amines. Particulate catalysts can also be used, such as pyrite, iron oxide, red mud, low concentrations of metals, such as molybdenum, and their compounds and combinations. Of course, in a thermal process no catalyst is necessary for the liquefaction or solvent refining reaction.

In the present invention, as well as other coal fuel processing schemes of the prior art, a feed coal is pulverized and combined with a solvent before being introduced into a reactor at high temperature, pressure and in the presence of hydrogen. The coal is liquefied and/or reduced in molecular weight. Downstream of the coal liquefier or refining reactor, the processed coal is separated by distillation into distillate components, solid reduced molecular weight components and mineral or insoluble coal components. The liquid component is further separated into a fuel product and a recycle solvent. Generally, in the prior art the recycle solvent has been reintroduced to the front end of the liquefaction or refining process flow scheme without further treatment or treatment confined to a rehydrogenation step.

Rehydrogenation of the solvent takes place in-situ in the reactor or dissolver when adequate reaction or residence time is provided. Therefore, the reactor is supplied with sufficient hydrogen at appropriate temperature, pressure and residence time such that the hydrogen-donor capacity of the solvent is replenished in-situ during the course of the reaction.

In the present invention, it has been found that treatment of the solvent which is being recycled to the front end of the liquefaction or refining stage in order to remove nitrogenous and phenolic constituents of the solvent dramatically improves the coal liquefaction or solvent refining reaction with the attendent increase in the proportion of oils or liquid hydrocarbons produced in those reactions. These nitrogenous and phenolic constituents of the solvent are derived from the feed coal and are also produced or freed during the liquefaction or refining stage of the process. It has been demonstrated that the removal of these compounds improves both catalytic and non-catalytic liquefaction and solvent refining processes.

The nitrogenous constituents, which are present as amines and other heteroatom structures, exhibit a generally basic functionality when present in the recycle solvent. Therefore, it has been found that contact of the solvent to be treated with an acid, such as anhydrous hydrochloric acid, successfully precipitates the offending nitrogenous components and allows for their separation from the solvent before recycle to the reactor stage of the process. The acid removal of the nitrogenous materials, specifically hydrogen chloride acid removal, is one of several ways contemplated and any process which successfully removes the nitrogenous component without negatively effecting the solvent would be deemed appropriate for the present invention. Other processes for nitrogenous removal would include hydrogen fluoride complexation, the complexing of nitrogenous bases by percolating the solvent through tubular columns over solid supports, such as ion exchange resins, acidic clays, acidic zeolites, acidic aluminas, silicas, charcoals, other carbon based surface-active agents or silicas all of various surface strength, or the use of weak acidic solutions of sulfuric acid. Selective distillation can also be used. The basic nitrogen removal or extraction can be accomplished at any reasonable temperature varying from sub-ambient up to 650° F., which is an upper limitation imposed on the basis of the typical boiling point of solvents utilized in liquefaction or solvent refining processes as practiced and demonstrated in the present invention. The pressure can be up to 2000 psi. The residual acids may be scrubbed from the supernatent liquid solvent by several methods, such as aqueous washing, percolation over solids such as bases, or other methods such as contact with ammonia. Although it is preferred that the entire recycle solvent stream be processed for removal of nitrogenous compounds, it can be contemplated that only a portion of the total recycle solvent stream experience treatment for the removal of basic nitrogen component buildup in the solvent at any particular time in the overall reaction. The equipment utilized for this treatment is, preferably, of the continuous type, such as a tubular or stirred reactor, although batch processing of the solvent in equipment, such as a stirred reactor may be performed as long as sufficient reservoirs of treated solvent and sufficient size in treatment facilities allow for the uninterrupted recycle of solvent.

In a similar manner, the removal of acidic phenolic compounds or active hydroxyl (OH) species from the recycle solvent can be accomplished by any number of chemical treatment techniques, such as:

(a) complexing of phenols by percolating the solvent through tubular columns over solid supports such as ion exchange resins, basic clays, basic zeolites, basic or neutral aluminas, active carbon or silicas of various surface strengths;

(b) extraction with weak basic solutions of various alkali hydroxides, such as, calcium, sodium or potassium;

(c) chemical derivatization with silanes, for example, hexamethyldisilazane; and (d) selective distillation as outlined above.

The temperature range over which this step may be accomplished ranges from sub-ambient up to 650° F. Residual base may be scrubbed from the supernatent liquid by several methods such as dilute aqueous acid washing, percolation over solids such as acids, or other methods performed to remove trace basic residues. Solvent feed to the base extraction unit may be from 5 to 90% of the total recycle solvent stream. Because phenol buildup in the recycle stream is, in certain instances quite low, residual phenol need not be removed on each pass. The equipment for removing the phenol compounds can be a continuous process using tubular or stirred reactors or a batch process using, if desired, stirred reactors. This phenol removal can be applied both to thermal, as well as strictly catalytic processes. For example, this process can be applied to processes in which coal slurries are fed to ebulated catalyst beds as in the H-Coal process, a fixed bed process as in the Synthoil process or a disposable catalyst process as in the Dow Liquefaction process. Again, the temperature can range from subambient to the boiling point of the particular solvent utilized, generally in the 650° F. and above range. The pressure can be up to 2000 psi. If caustic is utilized, residual caustic can be removed by aqueous washing of the treated solvent or bubbling $CO_2$ or treating with a weak acid, such as acetic acid. Again, the treatment for phenolic component removal in the solvent is, preferably, performed on the entire recycle of solvent, but it is contemplated that a portion of the solvent could be treated for phenolic component removal. Preferably, the phenolic extraction is conducted in a continuous process using a similar tubular or stirred reactor design as that utilized for basic nitrogen compound removal with appropriate variations in the metallurgical specification of the reactor for the particular reagent handled. Alternately, it is contemplated that a batch processing can be performed as long as the recycle of solvent is not interrupted.

The improved results of coal liquefaction or the solvent refining of coal is evidenced by the ensuing examples which demonstrate the improved reaction of coal with the attendent increase in the production of oils or liquid hydrocarbons which are the most desired product to be derived from the conversion of the feed. coal stock.

EXAMPLE 1

This example illustrates the treatment of a process solvent for the solvent refining of coal in order to remove basic nitrogenous components from the solvent. A sample of process solvent having the elemental composition and solvent separation analysis shown in Table 1 was mixed in a beaker with toluene in a 10 to 1 by volume toluene to solvent ratio. Anhydrous hydrochloric gas was bubbled through the solution for 20 minutes. Excess hydrochloric gas was removed from the solution by bubbling nitrogen through it. The solution was decanted to separate precipitated nitrogenous bases from the solvent solution. The solvent solution was then neutralized by bubbling ammonia through it. Again, excess ammonia was removed by passing nitrogen gas through the solution. Ammonium chloride formed by the reaction of ammonia with residual hydrogen chloride was filtered, and the toluene was rota-evaporated to recover the nitrogenous base free solvent. Elemental and solvent separation analysis of the nitrogenous base free solvent is given in the first column of Table 2. The precipitated nitrogenous bases can be recovered as a by-product by mixing with a second solvent, such as methylene chloride, and then neutralized by bubbling ammonia through it.

TABLE 1

| Analysis of Process Solvent | Weight % |
|---|---|
| Elemental Analysis | |
| Carbon | |
| Hydrogen | 7.2 |
| Oxygen | 1.4 |
| Nitrogen | 1.1 |
| Sulfur | 0.6 |
| Solvent Separation Analysis | |
| Oils | 92.8 |
| Asphaltenes | 5.8 |
| Preasphaltenes | 0.7 |
| Insoluble Organic Material | 0.7 |

EXAMPLE 2

This example illustrates the treatment of process solvent to remove phenolic components from the solvent. The process solvent described in Table 1 and identical to that used in Example 1 was mixed with toluene in a 7 to 1 by volume toluene to solvent ratio. The solution was treated 5 times with 50 ml of a 20% sodium hydroxide solution. The organic phase was separated from the aqueous phase and washed 5 times with 100 ml of water in order to remove any excess sodium hydroxide. The organic and the aqueous phases were separated again, and toluene was roto-evaporated from the organic phase to recover the phenol-free solvent. Elemental and solvent separation analysis of phenol-free solvent produced by the process of this example are given in the second column of Table 2. The phenol-rich aqueous phase can be treated further to recover phenols as a by-product.

EXAMPLE 3

This example illustrates the treatment of coal process solvent to remove nitrogenous basis components and phenolic components from the process solvent described in Table 1 and identical to that utilized in Example 1 and Example 2 above. The process solvent was mixed with toluene in a 10 to 1 by volume toluene to solvent ratio. Basic nitrogenous components were removed from the solution by bubbling hydrogen chloride through the solution for 20 minutes. Excess hydrogen chloride was removed by passing nitrogen through the solution. The solution was then decanted and roto-evaporated to remove precipitated nitrogenous material and toluene respectively. The thus treated solvent was mixed with 9 parts of pentane by volume. The resulting solution was mixed thoroughly with a 50–50 mixture of silica and neutral alumina (100–200 mesh). Adsorbed phenols and adsorbent were separated from the solvent solution by filtration. The filtrate was roto-evaporated to recover the treated solvent. The elemental and solvent separation analysis of the basic nitrogenous and acidic phenolic-free solvent are given in Table 2 at the the third column.

TABLE 2

| Analysis of Treated Solvents | Weight % | | |
|---|---|---|---|
| | Ex. 1 N—Base Free Solvent | Ex. 2 Phenol-Free Solvent | Ex. 3 N—Base & Phenol-Free Solvent |
| Elemental Analysis | | | |
| Carbon | 87.7 | 89.8 | 90.4 |
| Hydrogen | 7.5 | 7.4 | 8.5 |
| Oxygen | 1.5 | 1.1 | 0.4 |
| Nitrogen | 0.6 | 1.1 | 0.0 |
| Sulfur | 0.7 | 0.7 | 0.7 |
| Solvent Separation Analysis | | | |
| Oils | 95.2 | 94.3 | 95.8 |
| Asphaltenes | 4.5 | 5.3 | 2.2 |
| Preasphaltenes | 0.2 | 0.4 | 2.0 |
| Insoluble Organic Material | 0.1 | 0.1 | 0.0 |

EXAMPLE 4

This example illustrates the reaction of coal with untreated process solvent in a non-catalytic reaction. The coal feed was comprised of Kentucky Elkhorn No. 3 coal having a proximate analysis of: fixed carbon 46.03 wt %, volatiles 37.56 wt %, dry ash 14.6 wt %, and moisture 1.81 wt %. The coal was mixed with a process solvent having the elemental and solvent separation analysis as shown in Table 1. A coal-oil slurry (6 g solvent and 3 g coal) was reacted in a 46.3 ml tubing-bomb reactor at a cold hydrogen pressure of 1,250 psig. A reaction temperature of 797° F. and a residence time of 60 minutes were used for the base reaction. A reaction product having a product distribution as shown in the first column of Table 3 was obtained from the process as described above. The conversion of coal was 73% and the oil yield was −2% based on moisture and ash free (MAF) coal. This demonstrates a disappointing but not unexpected conversion and reaction product in a non-catalytic untreated coal reaction.

EXAMPLE 5

This example illustrates the liquefaction or solvent refining of coal in a non-catalytic reaction utilizing solvent which has been treated to remove nitrogenous basic components. A coal-oil mixture comprised of coal described in Example 4 and a nitrogenous component-free solvent described in Example 1 was processed at the same reaction conditions described in Example 4. The reaction product had a product distribution as shown in the second column of Table 3. The coal conversion and the oil production for the example were similar to that of Example 4.

EXAMPLE 6

This example illustrates the reaction of coal such as that described in Example 4 and a solvent which is treated to remove phenolic components such as that described in Example 2. The composition of the coal slurry and the reaction conditions were the same as described in Example 4 above. The reaction product had a product distribution as shown in the third column of Table 3 and was once again very similar to the reaction product distribution of Example 4 and Example 5.

EXAMPLE 7

This example illustrates the reaction of coal such as described in Example 4 and a solvent which has been treated to remove nitrogenous components and phenolic components as described in Example 3. The composition of the coal slurry and the reaction conditions were the same as described in Example 4. The reaction product had a product distribution as shown in Table 3 in the fourth column. The conversion of coal was slightly higher than in any of the previous examples. However, the significant parameter is the high oil production when utilizing a solvent which is treated for the removal of nitrogenous and phenolic components. The oil fraction of the conversion in the example was 23 wt %, which when compared to the negative values in the previous reactions including those with individual treatment for nitrogenous and phenolic components it is evident that an unusual and unexpected improvement in the reaction is demonstrated when not just one, but both of the subject components are removed from a process solvent in a coal liquefaction or solvent refining reaction. This represents a thermal or non-catalytic reaction sequence.

TABLE 3

Conversion and Product Distribution of Kentucky Elkhorn #3 Coal Without Any Catalyst

| Product Distribution, Wt. % MAF Coal | Ex. 4 Original Solvent | Ex. 5 N—Base Free Solvent | Ex. 6 Phenol Free Solvent | Ex. 7 N—Base and Phenol Free Solvent |
|---|---|---|---|---|
| Gas, % | 9 | 9 | 7 | 10 |
| Oils, % | (2) | (3) | (6) | 23 |
| Asphaltenes, % | 44 | 42 | 47 | 28 |
| Preasphaltenes, % | 22 | 23 | 23 | 13 |
| I.O.M., % | 27 | 29 | 29 | 25 |
| Conversion, % | 73 | 71 | 71 | 75 |

| | |
|---|---|
| Feed Composition | 6 g Solvent, 3 g Coal |
| Temp., °C. | 425 |
| Time, Min. | 60 |
| Hydrogen Pressure, psig at 25° C. | 1250 |

( ) - Indicate negative value

EXAMPLE 8

This example illustrates the reaction of coal in a catalyzed reaction process. A coal slurry comprising the Kentucky Elkhorn No. 3 coal described in Example 4 with a process solvent having the analysis as shown in Table 1 was mixed with a pyrite catalyst. The coal-oil-catalyst slurry (6 g solvent, 3 g coal and 1 g pyrite) was reacted in a tubing-bomb reactor at the same reaction conditions described in Example 4. The reaction product had a product distribution as shown in Table 4 in the first column. The conversion of coal was 87% and the oil yield was 24% based on moisture and ash free (MAF) coal. The conversion and oil production were significantly higher than shown in Table 3 for Example 4 and are typical of the difference between non-catalyzed and catalyzed coal reactions. This example provides a base statistical case for catalyzed reactions using an untreated solvent.

EXAMPLE 9

This example illustrates the reaction of coal with a solvent, which is treated to remove the nitrogenous components therefrom as described in Example 1, in a catalyzed coal liquefaction or solvent refining reaction process. Specifically, the reaction is catalyzed with pyrite. The composition of the slurry and the reaction conditions were the same as described in Example 8 above. The reaction product had a product distribution as shown in Table 4 in the second column. The conversion of coal and the oil yield were considerably higher than shown in the control run in Example 8 or the non-catalyzed run in Example 5. The conversion was 89 wt %, while the oil yield was 31 wt %.

EXAMPLE 10

This example illustrates the reaction of coal with solvent which is treated for the removal of phenolic compounds, as described in Example 2, in a catalyzed liquefaction reaction utilizing pyrite as the catalyst. The composition of the coal-solvent slurry and the reaction conditions for this example were the same as those conditions described in Example 9. The reaction product had a product distribution as shown in Table 4 in the third column. Specifically, the conversion of coal was 88 wt % and the oil yield was 30 wt %. This indicates a similar yield to the example utilizing nitrogenous compound free solvent and an improved result over the Example 8 utilizing untreated solvent and Example 6 using a noncatalyzed phenol-free solvent.

EXAMPLE 11

This example illustrates the reaction of coal with a solvent which has been treated for the removal of both nitrogenous compounds and phenolic compounds as described in Example 3. The reaction was conducted in the presence of a pyrite catalyst. The composition of the slurry and the reaction conditions were the same as described in Example 9 except for solvent treatment. The resulting reaction product had a product distribution as shown in Table 4 in the fourth column, in which a higher coal conversion rate of 89% over that of the control example, Example 8, and a significantly higher oil yield of 48 wt % was experienced. The reaction in this example, utilizing solvent treated for the combination of nitrogenous and phenolic compounds, shows a significant and marked oil yield improvement over not only the control example, Example 8, but also Example 9 and Example 10 wherein the reaction utilized solvent treated for the removal of only nitrogenous components or phenolic components, respectively.

TABLE 4

Conversion and Product Distribution of Kentucky Elkhorn #3 Coal With Pyrite Catalyst

| Product Distribution, Wt. % MAF Coal | Ex. 8 Original Solvent | Ex. 9 N—Base Free Solvent | Ex. 10 Phenol Free Solvent | Ex. 11 N—Base and Phenol Free Solvent |
|---|---|---|---|---|
| Gas, % | 8 | 6 | 7 | 8 |
| Oils, % | 24 | 31 | 30 | 48 |
| Asphaltenes, % | 42 | 39 | 35 | 26 |
| Preasphaltenes, % | 13 | 13 | 16 | 7 |
| I.O.M., % | 13 | 11 | 12 | 11 |
| Conversion, % | 87 | 89 | 88 | 89 |
| Feed Composition | | | 6 g Solvent, 3 g Coal, 1 g Pyrite | |
| Temp., °C. | | | 425 | |
| Time, Min. | | | 60 | |
| Hydrogen Pressure, psig at 25° C. | | | 1250 | |

EXAMPLE 12

This example illustrates the treatment of solvent to remove nitrogenous components and phenolic components. A sample of the process solvent which was described in Table 1 and utilized in Example 1 was mixed with toluene in a 10 to 1 by volume toluene to solvent ratio. The nitrogenous components of the solvent were removed from the solution by bubbling hydrogen chloride through the solvent for 20 minutes. Hydrogen chloride was removed by first passing nitrogen through the solution, and then the solution was then decanted and ammonia was passed through the solvent for 5 minutes to remove any remaining hydrogen chloride. No precipitate was formed at this time. Excess ammonia was then removed by passing nitrogen through the solution. The solution was roto-evaporated. The roto-evaporated solution was mixed with 10 parts of pentane by volume. The resulting solution was mixed well with 100 g of silica and 100 g of neutral alumina (100–200 mesh). The mixture was filtered to separate nitrogenous components and phenolic components from the solvent. The filter cake was washed with pentane and the filtrate was roto-evaporated to recover the treated solvent. Elemental and solvent separation analysis of the nitrogenous and phenolic component-free solvent are shown in Table 5. This example duplicates Example 3 and the results demonstrate the reproducibility of the solvent characteristics which are demonstrated in Table 2 in the third column.

TABLE 5

Analysis of Treated Solvent

| | Weight % Ex. 12 N—Base and Phenol-Free Solvent |
|---|---|
| Elemental Analysis | |
| Carbon | 90.9 |
| Hydrogen | 7.7 |
| Oxygen | 0.6 |
| Nitrogen | 0.06 |
| Sulfur | 0.8 |
| Solvent Separation Analysis | |
| Oils | 100.0 |

EXAMPLE 13

This example illustrates the reaction of coal when reacted in conjunction with a solvent which is free of nitrogenous and phenolic components such as described in Example 12. This example was a non-catalyzed reaction wherein the coal, the composition of the coal slurry and the reaction conditions were identical to those in Example 4. The reaction product of this example had a product distribution as shown in Table 6. The conversion of coal was similar to that shown in the examples reported in Table 3. The oil yield was significantly above the untreated or individually treated solvent runs reported in Table 3, specifically Examples 4, 5 and 6, but was less than the oil yield reported in Example 7.

TABLE 6

Liquefaction Product Distribution of Kentucky Elkhorn #3 Coal Without Any Catalyst

| | Ex. 13 N—Bases and Phenol-Free Solvent |
|---|---|
| Product Distribution, Wt. % MAF Coal | |
| Gas, % | 12.9 |
| Oils, % | 11.6 |
| Asphaltenes, % | 30.9 |
| Preasphaltenes, % | 17.6 |
| I.O.M., % | 27.1 |
| Conversion, % | 72.9 |
| Feed Composition | 6g Solvent, 3g Coal |
| Temp, ° C. | 425 |
| Time, Min. | 60 |
| Hydrogen Pressure, psig at 25° C. | 1250 |

EXAMPLE 14

This example illustrates the reaction of coal described in Example 4 with a solvent which has been treated for the removal of nitrogenous and phenolic components as described in Example 12. The reaction is a catalyzed reaction utilizing pyrite as the catalyst. The composition of the coal slurry and the reaction conditions were the same as those described in Example 9. The example was divided into two runs, both of which runs are reported in Table 7 wherein the product distribution for the reaction product is shown. The oil yield for these two runs, being 37.9 wt % and 38.6 wt %, respectively, showed significant improvement over reactions run with untreated solvent and solvent treated for individual contaminents, specifically Examples 8–10.

TABLE 7

| Conversion and Product Distribution of Kentucky Elkhorn #3 Coal With Pyrite | Ex. 14 N—Base and Phenol Free Solvent | |
|---|---|---|
| | Run #1 | Run #2 |
| Product Distribution, Wt. % MAF Coal | | |
| Gas, % | 4.6 | 4.6 |
| Oils, % | 37.9 | 38.6 |
| Asphaltenes, % | 35.0 | 35.6 |
| Preasphaltenes, % | 9.3 | 10.3 |
| I.O.M., % | 13.2 | 11.0 |
| Conversion, % | 86.8 | 89.0 |
| Feed Composition | 6g Solvent, 3g Coal, 1g Pyrite | |
| Temp., °C. | 425 | |
| Time, Min. | 60 | |
| Hydrogen Pressure, psig at 25° C. | 1250 | |

The above examples indicate that the treatment of solvent as described in the present invention improves the reaction performance of coal liquefaction and solvent refining. This is true for non-catalyzed reactions and catalyzed reactions alike. The improvement in oil yield in both catalyzed and non-catalyzed reactions is approximately of the same magnitude, although the absolute oil yield data for the catalyzed reactions is decidedly higher, as would be expected and improvement is noted in the catalyzed reactions with only phenol or nitrogen removed individually.

It has been found that any significant reduction of the content of the recycle solvent of nitrogenous and phenolic constituents affects the coal reaction beneficially. However, it is preferred to remove a predominant amount of such constituents, and if economically feasible, it is beneficial to remove essentially all of the nitrogenous and phenolic constituents. Generally, a significant level of nitrogenous constituent removal is up to 20% removal of the constituent from the recycle solvent. A significant level of phenolic removal would be up to 20% removal of the constituent from the recycle solvent. A predominant level or amount of nitrogenous constituent removal is deemed to be greater than 20% removal, while a predominant level of phenolic constituent removal is deemed to be greater than 20% removal.

The use of the solvent treatment process of the present invention for coal liquefaction or solvent refining processes is demonstrated to have significant and unexpected benefits for both catalyzed and non-catalyzed reactions. Although the removal of nitrogenous components or phenolic components of the process solvent individually provides some improvement in the product distribution and specifically the oil yield, even greater results are demonstrated by the removal of nitrogenous and phenolic components from the same process solvent. In the case of a catalyzed reaction, sufficient production is available that it may be desireable to remove only one constituent of the nitrogenous or phenolic compounds. Alternately, a portion of the recycle solvent can be recycled untreated if the constituents are in low concentration. The effect of this combination removal is unexpected and uncontemplated by the prior art. It is deemed to be relevant to any coal liquefaction or solvent refining technique in which a solvent having these nitrogenous and phenolic compounds, and more specifically, a solvent which is recycled to the reaction zone is utilized. With this overall applicability in mind, the following preferred technique for the solvent refining of coal will demonstrate the utility of the present invention, but should not be deemed to be a limitation on the applicability of the process of the present invention.

The preferred embodiment for the solvent refining of coal utilizing the solvent treatment of the present invention consists of a slurry phase reactor in which the coal in a solvent with catalysts is liquefied and reduced in molecular weight. The slurry phase includes a powdered or particulate catalyst in a stream of liquid dispersed coal feed. The catalyst is added in the feed stream and deactivated catalyst is removed in the product stream, so that separate addition of catalyst or its removal is not necessary. Slurry phase reactors for coal processing are well known in the art as set forth above and no further detailed discussion of such reactor specifics is deemed necessary.

As shown in FIG. 1, the preferred flow scheme for the use of the solvent treatment technique of the present invention is set forth. Particulate feed coal is introduced into the process through line 4 wherein it is mixed in a slurry mix vessel 5 with a pasting solvent in line 3, a catalyst in line 2 and, optionally, a portion of residual SRC (solvent refined coal) material recycled from the downstream portion of the reactor in line 49. The slurry in mix vessel 5 comprises coal, pretreated solvent, catalyst and SRC. This mixture is then conducted through line 8 to a fired heater vessel 10. During the transmission of the coal slurry from vessel 5 to vessel 10, hydrogen gas is introduced into the slurry in line 9. The temperature of the slurry is rapidly increased in the heater 10. The heated slurry is then passed through line 15 to the slurry phase reactor 18 where liquefaction or solvent refining of the coal material is performed. Only one reactor 18 is shown in FIG. 1, but in actual practice, a number of reactors in series may be utilized for more complete reaction of the coal and control over the reaction phases. Additional fresh hydrogen rich gas is introduced into the reactor through line 17. The feed coal is liquefied or solvent refined to a lower molecular weight in the reactor 18 and passes from that reactor in line 20 into a high pressure separator system 26 in which gaseous effluent is separated from the condensed phase. The gas phase is passed from the separator 26 through line 24 to a gas separation and purification zone, which is not shown, where hydrogen enriched gases are separated and purified and passed to the preheater section 10 and liquefaction zone 18 through lines 9 and 17, respectively. The gas separator zone, if desired, may comprise a series of step drops in pressure which produce other streams substantially richer in material other than hydrogen which can be processed and used or sold as plant product. In this case, additional effluent lines such as line 25 would be incorporated in order to remove a particular fraction of gaseous product. The non-gaseous product from zone 26 is passed to a vacuum distillation zone 37 through line 27. A light distillate fraction boiling at approximately 425° F. or above is passed from the still through line 39 to storage as a product. A recycle distillate solvent is passed from the distillation zone 37 through line 38 to the solvent treatment vessel 29, where the heteroatom rich stream in line 38 is treated for the removal of nitrogenous and phenolic components to produce a substantially pure recycle stream in line 3. A portion of the solvent in line 38 can be removed in line 35 as product for export. The heteroatoms can be collected and sent to processing for potential product availability in line 30. The extracted recycle solvent in line 3 is then reintroduced into the slurry mix vessel 5 for continued duty in coal liquefaction or solvent refining. A portion of the treated solvent can be removed in line 31 as product for export.

Alternately, the solvent in line 38 can be split and at least a portion of it can be bypassed in line 33 around the treatment zone 29. This can be done anytime there is a tolerable amount of nitrogenous or phenolic constituent in the solvent, but it is particularly attractive when distillation of the solvent can be achieved.

In solvent distillation, the process solvent which boils at 450° F. to 850° F. can be distilled in two major fractions, one of which boilts at 450° F. to 650° F. and the other of which boils at 650° F. to 850° F. The lower boiling fraction is characteristically rich in phenols and poor in nitrogenous bases. The higher boiling fraction is characteristically poor in phenols and rich in nitrogenous bases. The fractions can be treated separately to remove the individual rich component and then recombined for recycle to the reactor or dissolver. If sufficient recycle is present, only one fraction can be treated and the untreated fraction can be exported as product.

The bottoms material from the vacuum distillation zone 37, which bottoms material contains soluble solvent refined coal, unconverted coal macerals and mineral matter is passed to a solid separation zone 43 through line 41. The solid separation zone 43 may comprise a critical solvent separation apparatus, such as is known in the art and further described, for example in U.S. Pat. No. 4,119,523, which is incorporated herein by reference. The solid insoluble material is removed from the zone 43 in line 45 which effluent can be passed to a gasifier to generate hydrogen for in-plant utilization, if so desired. Deashed products having various compositions graded specifically by different levels of benzene insolubles can also be produced from material processed in the solid separation zone 43. Specifically, an effluent product having a low level of benzene insolubles can be removed in line 48 while a product having a high level of benzene insolubles can be produced and passed through line 46 to product storage. A portion of this low level benzene insoluble coal product can be recycled to the slurry mix tank 5 through line 49. This flow scheme for the slurry phase treatment of feed coal to produce liquid fuels and solvent refined coal product demonstrates at least one overall process in which the solvent treatment concept of the present invention can be utilized. This flow scheme represents a catalyzed reaction. However, it is within the contemplation of this patent to use the solvent treatment step in other coal fuel processing flow schemes such as thermal, non-catalytic processes or other catalytic processes such as an ebullated bed coal reactor, a fluidized bed reactor, or a fixed bed reactor.

As has been demonstrated above, the present invention provides an improved process for the treatment of coal to provide liquid and solid fuels wherein the purification of the solvent, and specifically the recycle solvent from such a coal process, is performed to remove nitrogenous and phenolic components which have been found to be detrimental to coal reactions, either catalytic or non-catalytic. Preferred processes for removing such components from solvent and a system in which the solvent purification can be utilized in conjunction with a slurry phase reactor have been disclosed, but the invention is deemed to be applicable to other coal processes as recited above and therefore the invention's scope should be ascertained by the claims which follow.

We claim:

1. A process for the thermal solvent refining of coal at elevated temperature and pressure in a hydrogen atmosphere using a hydrocarbon solvent boiling in the range of 450° to 850° F. which is recycled, to produce liquid hydrocarbons and normally solid, solvent-refined coal, wherein the improvement comprises removing essentially all of the nitrogenous base and phenolic constituents from the recycle solvent prior to mixing the solvent with feed coal for solvent refining in order to improve the solvent refining reaction with the attendant increase in the proportion of oil produced in said reaction.

2. A process for the catalytic solvent refining of coal at elevated temperature and pressure in a hydrogen atmosphere using a hydrocarbon solvent boiling in the range of 450° to 850° F., which is recycled, and in the presence of an added catalyst to produce liquid hydrocarbons and normally solid, solvent-refined coal, wherein the improvement comprises removing a predominant amount of the nitrogenous base constituents from the recycle solvent prior to mixing the solvent with feed coal for solvent refining in order to improve the solvent refining reaction with the attendant increase in the proportion of oil produced in said reaction.

3. A process for the catalytic solvent refining of coal at elevated temperature and pressure in a hydrogen atmosphere using a hydrocarbon solvent boiling in the range of 450° to 850° F. which is recycled, and in the presence of an added catalyst to produce liquid hydrocarbons and normally solid, solvent-refined coal, wherein the improvement comprises removing a predominant amount of the phenolic constituents from the recycle solvent prior to mixing the solvent with feed coal for solvent refining in order to improve the solvent refining reaction with the attendant increase in the proportion of oil produced in said reaction.

4. The process of claim 1 or 2 wherein the nitrogenous base constituents are removed by contact of the solvent with hydrogen chloride.

5. The process of claim 1 or 3 wherein the phenolic constituents are removed by contact of the solvent with sodium hydroxide.

6. The process of claim 1 or 3 wherein the phenolic constituents are removed by contact of the solvent with a mixture of silica and alumina.

7. The process of claim 1, 2 or 3 wherein the solvent refining reaction is conducted at a pressure of at least 500 psia and a temperature of at least 650° F.

8. The process of claim 2 wherein a predominant amount of the phenolic constituents are also removed from the solvent.

9. The process of claim 2 wherein the solvent treatment removes essentially all of the nitrogenous base compounds from the solvent.

10. The process of claim 3 wherein the solvent treatment removes essentially all of the phenolic content of the solvent.

11. The process of claim 8 wherein essentially all of the nitrogenous base and phenolic constituents are removed from the recycle solvent.

* * * * *